US009994779B2

(12) United States Patent
Ancheyta Juarez et al.

(10) Patent No.: US 9,994,779 B2
(45) Date of Patent: Jun. 12, 2018

(54) HYDROCONVERSION PROCESS TO UPGRADE THE TRANSPORT PROPERTIES OF HEAVY AND EXTRA-HEAVY CRUDE OILS AT LOW SEVERITY CONDITIONS USING DISPERSED-PHASE CATALYST

(71) Applicant: INSTITUTO MEXICANO DEL PETROLEO, Mexico City (MX)

(72) Inventors: Jorge Ancheyta Juarez, Mexico City (MX); Sergio Ramirez Amador, Mexico City (MX); Zenaida Carolina Leyva Inzunza, Mexico City (MX); Alexander Quitian Arciniegas, Mexico City (MX)

(73) Assignee: Instituto Mexicano Del Petroleo, Mexico City (MX)

( * ) Notice: Subject to any disclaimer, the term of this patent is extended or adjusted under 35 U.S.C. 154(b) by 53 days.

(21) Appl. No.: 15/182,319

(22) Filed: Jun. 14, 2016

(65) Prior Publication Data

US 2016/0362615 A1 Dec. 15, 2016

(30) Foreign Application Priority Data

Jun. 15, 2015 (MX) ..... MX/a/2015/007604

(51) Int. Cl.
*C10G 47/02* (2006.01)
*C10G 47/04* (2006.01)
(Continued)

(52) U.S. Cl.
CPC ..... *C10G 47/04* (2013.01); *C10G 45/04* (2013.01); *C10G 45/06* (2013.01); *C10G 45/08* (2013.01);
(Continued)

(58) Field of Classification Search
CPC ..... C10G 45/04; C10G 45/06; C10G 45/08; C10G 45/14; C10G 47/02; C10G 47/04; C10G 47/24; C10G 49/10; C10G 65/14
See application file for complete search history.

(56) References Cited

U.S. PATENT DOCUMENTS

2016/0060549 A1* 3/2016 Ancheyta Juarez ... C10G 67/00 208/88

OTHER PUBLICATIONS

Alexander Quitian, Carolina Leyva, Sergio Ramirez and Jorge Ancheyta; "Exploratory Study for the Upgrading of Transport Properties of Heavy Oil by Slurry-Phase Hydrocracking"; Energy Fuels, 2015, 29 (1), pp. 9-15; DOI: 10.1021/ef501577d; Dec. 18, 2014.

* cited by examiner

*Primary Examiner* — Brian A McCaig
(74) *Attorney, Agent, or Firm* — Dickinson Wright, PLLC

(57) ABSTRACT

The present invention relates to a catalytic hydroconversion process in dispersed phase of extra-heavy and heavy crude oils for upgrading their transport properties, that operates at low severity conditions, in such a way that the obtained product can be transported by conventional pumping to the distribution and refining centers.

The main technical contributions of the hydroconversion process in dispersed phase of this invention to upgrade the transport properties of heavy and extra-heavy crudes are:

- Compact size and can be localized next to the production facilities on ground or offshore
- Use of operating conditions at low severity
- Reduction of the viscosity and increase of the API gravity at values that allow the transportation by pipeline of heavy or extra-heavy crude
- Upgrading of the crude oil properties in a permanent way
- Hydrocarbon and gases from production centers are used as supplies (Continued)

Operation in dispersed phase avoiding plugging problems
Use of low-cost disposable catalysts at low concentrations.

10 Claims, 1 Drawing Sheet

(51) Int. Cl.

| | |
|---|---|
| ***C10G 47/24*** | (2006.01) |
| ***C10G 45/04*** | (2006.01) |
| ***C10G 45/06*** | (2006.01) |
| ***C10G 45/08*** | (2006.01) |
| ***C10G 45/14*** | (2006.01) |
| ***C10G 49/10*** | (2006.01) |
| ***C10G 65/14*** | (2006.01) |

(52) U.S. Cl.
CPC ..... *C10G 45/14* (2013.01); *C10G 47/02* (2013.01); *C10G 47/24* (2013.01); *C10G 49/10* (2013.01); *C10G 65/14* (2013.01); *C10G 2300/302* (2013.01); *C10G 2300/308* (2013.01)

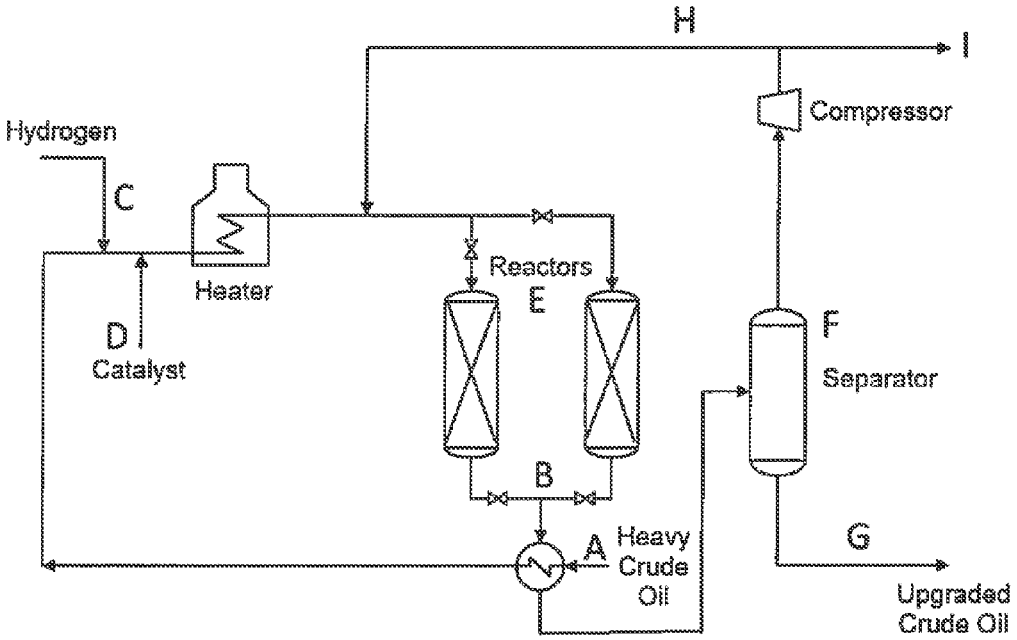
H
I
Compressor
Hydrogen
C
Heater
Reactors
E
D
Catalyst
F
Separator
B
A
Heavy
Crude
Oil
G
Upgraded
Crude Oil

HYDROCONVERSION PROCESS TO UPGRADE THE TRANSPORT PROPERTIES OF HEAVY AND EXTRA-HEAVY CRUDE OILS AT LOW SEVERITY CONDITIONS USING DISPERSED-PHASE CATALYST

TECHNICAL FIELD

This application claims a low severity process which can be used in the petroleum industry for upgrading of transport properties of heavy and extra-heavy crudes oils, in order to facilitate their movability from the production fields to distribution centers and refineries. The process is based on the hydroconversion of heavy and extra-heavy crude oils, more specifically to the catalytic hydroconversion of heavy and extra-Heavy crude oils using dispersed-phase catalysts. The hydroconversion is carried out at low severity reaction conditions. The process of this invention can be implemented on ground, maritime or offshore facilities.

BACKGROUND OF THE INVENTION

The oil industry has faced important changes in recent years. The production of light crude oil has decreased around the world, while the production of heavy and extra-heavy crude oils has been increasing. This situation has brought several drawbacks in the production, transportation, storage and refining of such crude oils.

Because of their properties of high specific gravity and high viscosity, heavy and extra-heavy crude oils require the application of different procedures and technologies to allow maintaining their fluidity and thereby be able to be transported from the production facilities to the distribution and refining centers, which are typically located hundreds of kilometers away.

The American Petroleum Institute classifies petroleum as "heavy" and "extra-heavy" according to the gravity API:

Heavy crude oils: have API gravities between 10 and 22.3°API; and

Extra-heavy crude oils: have API gravities less than 10°API.

The most important property that defines if a heavy or extra-heavy crude oil can be transported by pipeline or not is the viscosity. The most common specification is a maximum value of kinematic viscosity of 250 centistokes (c t) at 37.8° C. (100° F.). API gravity is also used to determine the transportability of a heavy or extra-heavy crude oil, however, depending on the origin and nature of the crude oil, the API gravity value to ensure its transportation by pipeline ranges between 16-20°API minimum.

The procedures and technologies used for transporting the extra-heavy and heavy crude oils by pipeline can be classified into two groups: (1) viscosity reduction of heavy crude oils, and (2) reduction of friction of hydrocarbon within the pipeline. To upgrade the transport properties of heavy and extra-heavy crude oils, particularly the viscosity reduction, which is the main objective of this invention, the following methods are considered: (1) heating, (2) dilution, and (3) formation of emulsions, and (4) partial upgrading. Different procedures and technologies can be applied in each method.

Heating has a major effect on the viscosity of heavy crude oils and extra-heavy but it is difficult to carry out at practical level, consequently dilution methods have been the most used, however large amounts of solvents are required, which normally have a high cost. These procedures have a number of technological and economic limitations therefore their application is limited with the objective of not increasing the production costs of heavy crude oils.

The alternative of partial upgrading of the properties of heavy crude oils is a viable option in order to the transportation be possible in conventional production facilities to from a ground or maritime production center to the distribution and refining centers.

In order to maintain the profitability in the production of heavy crude oil, the upgrading process must satisfy certain characteristics: (1) it must be located near the centers of production, (2) it must need low amounts of catalyst, (3) it must use cheap catalyst and easy to obtain utilities in production center, (4) it must not generate large quantities of by-products that they require further processing, (5) it has to be of high capacity, but of small size.

The most related state-of-the-art to this invention by referring to the use of processes that combine several steps and/or refining steps (combined processes) to upgrade the properties of heavy and extra-heavy crude oils are represented by the following documents:

U.S. Pat. No. 4,485,004 (1984) protects a dispersed-phase hydrocracking process that operates at temperatures between 400 and 450° C., pressures between 110 and 170 $Kg/cm^2$ and residence times between 2 and 3.5 hours. It uses dispersed catalysts based on cobalt, molybdenum, nickel and tungsten in concentrations between 3 and 5% respect to the feed. The hydrocracking catalyst may be fresh or spent and is diluted in a hydrogen donor hydrocarbon. The catalyst is composed of one or more of the following elements: Co, Mo, Ni, W and mixtures thereof. The used types of hydrogen donor include hydrocarbons such as tetralin or others with the ability of transferring hydrogen atoms to the thermally cracked fractions for example refinery streams such as cycle oils with boiling point about 200° C. The hydrocracked product is separated into different fractions according to their boiling point. The catalyst can be used in powder form with particle sizes between 425 μm and 45 μm (40 and 325 meshes according to ASTM E 11-87 method). The catalyst concentration can be from 3% to 5% and is fed together with the hydrocarbon. A portion of the recovered fraction that contain the catalyst in liquid phase is recirculated to the reactor.

U.S. Pat. No. 5,626,742 (1995) describes a continuous process for in situ upgrading of heavy crude oils using aqueous base (NaOH). It uses a temperature between 380 and 450° C. The main objective of this process is the upgrading through sulfur removal associated to organic molecules.

U.S. Pat. No. 8,062,503 (2007) protects a thermal upgrading process of heavy crude oils and residues using a pyrolysis reactor with a short residence time. The upflow stream of hydrocarbon is passed through a solid support (calcium oxide) where hydrocracking reactions occur. The operating temperature of this pyrolysis reactor is between 300 and 700° C. with a contact time between the hydrocarbon and the solid of less than 5 seconds.

U.S. Pat. No. 7,381,320 (2008) protects a type of even more complex applications that includes several processes of different nature as the separation of the heavy fractions by solvent extraction, fluid catalytic cracking and hydrocracking of heavy crude oil, as well as the effluent treatment plants for the used processes. Finally, it includes the formulation of the upgraded oil.

U.S. Pat. No. 7,449,103 (2006) claims the use of catalysts in colloidal or molecular phase in an ebullated bed reactor. The soluble catalyst is diluted in a hydrocarbon (vacuum gas oil, decanted oil, cycle oil or light gas oil) before its addition to the reactor. The reactor system can employ a homogeneous phase reactor and after an upstream ebullated bed reactor with larger catalyst particles. The catalyst used is molybdenum 2-ethylhexanoate with about 15 weight % Mo and with particle sizes less than 0.001 μm.

U.S. Patent application No. 20100200463 A1 describes a hydroconversion process at high severity using a molybdenum catalyst in dispersed phase in an array of at least two reactors in series. Operating temperature and pressure for this process are 400-480° C. and 200 $Kg/cm^2$ respectively.

U.S. Patent application No. 20110155639 describes a process for producing synthetic crude oil that can be transportable by pipeline. It involves obtaining the heavy fraction of this crude oil (vacuum residue) which is subsequently subjected to a hydroconversion process in an ebullated bed reactor. The operating conditions no used in this reactor are the following: pressure of between 105 to 210 $Kg/cm^2$, temperature between 400 to 450° C., hydrogen/hydrocarbon ratio between 1.500 to 10.000 $ft^3$/bbl, space velocity of 0.1 to 1.5 $hr^{-1}$ and a daily replenishment of catalyst 0.1 to 1.0 lb/bbl of feed. Several steps are involved: feeding heavy oil to a fractionation tower to obtain a light fraction and a heavy fraction, recovery by distillation of a vacuum residue, feeding of the vacuum residue together with hydrogen to a reaction system of ebullated bed type, and finally the hydroconverted residue is mixed with the light fraction for the preparation of an upgraded crude oil.

U.S. Patent Application No. A1 20110163004 proposes a system based on the creation of high pressure pulses on hot heavy crude oil in order to crack it and produce a crude oil with a lower viscosity.

U.S. Patent Application No. US 20120270957 A1 describes a process for reducing the viscosity and the contents of sulfur, metals and asphaltenes in bitumen. The process involves a number of well-known treatments such as: Fischer-Tropsch process for hydrogen generation, a hydrogenation reactor, and another upgrading operations and separation of hydrocarbons processes.

Regarding to the used catalyst in such processes, several patents describe a large number of materials used to upgrade the different hydrocarbon cuts. They are based mainly on the catalytic properties of heavy metals such as Mo, Ni, Co, Ti, W, and combinations with other elements such as C, O, S, P, etc. These elements are involved in the reactions of hydrocracking, hydrogen adsorption, and C—S bond breaking which together upgrade the properties of various cuts of hydrocarbons, from gasoline to heavy crudes oils and residues. Supports or refractory oxide based Al, Si, Ti, among others are other important elements of composition of these catalysts. Such supports can be amorphous or crystalline, such as zeolites and they give different properties of acidity or basicity to the catalyst.

U.S. Patent Application No. 20090011931 A1 explains the preparation and use of a catalyst which involves the utilization of a Group VIB metal oxide ($MoO_3$) together with an aqueous ammonia solution. $H_2S$ addition steps are included (necessary to sulfidation of the metal oxide) and hydrogen. This mixture is combined with the heavy hydrocarbon at operating conditions that maintain the catalyst in solution.

Mexican Application Patents with file numbers MX/a/2010/013890 and MX/a/2010/013835 employ catalysts of iron oxide and alumina between 0.1 and 4 wt. %. These patents also describe good results using bauxite. This process operates at pressures in the range of 100 to 170 $Kg/cm^2$, temperature between 440-465° C. and LHSV from 0.1 to 3 $hr^{-1}$ using tubular reactors with upflow or downflow.

From the state-of-the-art described above known by the applicants, none of them describe a dispersed-phase hydrocracking process at low severity conditions using disposable low-cost catalysts, whose objective is the upgrading of the transport properties of extra-heavy and heavy crude oils.

It is therefore the purpose of this invention to provide an upgrading process that comprises the catalytic hydroconversion of heavy and/or extra-heavy crude oils using a disposable and low-cost catalyst.

The aim of the process and catalyst is to upgrade the transport properties of heavy and extra-heavy crude oils to be transported in production facilities and to distribution and refining centers.

An additional objective of this invention is to provide a process with low operating and investment costs that can be installed in the production centers of crude oils either on ground or offshore.

The severity of the process is limited to upgrade the transport properties of the heavy crude oil that is obtained from the production centers.

BRIEF DESCRIPTION OF THE FIGURES

FIG. 1 shows a typical flow diagram of the hydroconversion process in dispersed-phase of heavy crude oils which illustrates the best way known by the applicants of this invention and that serves as a reference in the application examples.

Although the diagram of FIG. 1 illustrates the specific provisions of equipment whereby this invention can be practically applied, it should not be to understand that this limits the invention to some specific equipment.

DETAILED DESCRIPTION OF THE INVENTION

This invention relates to the application of a catalytic hydroconversion process in dispersed phase to upgrade the transport properties of heavy and extra-heavy crudes at operating conditions of low severity. It is designed to operate with feeds of heavy and extra-heavy crude oils with API gravity of 3 to 16 units. Due to the nature of the feed, the process includes its preheating and of the pipelines aiming at introducing the feed to the catalytic hydroconversion reactor in disperse phase, that is the object of this invention. Preheating of the feed can be carried out by heat exchange with the hot streams of the same unit, while the heating of pipelines can be carried out using steam jackets. Under these conditions, the configuration of the process and the equipment is aimed at optimizing the energy balance when streams of high molecular weight and high viscosities are handled.

For the purposes of this invention, the term "low severity conditions" describes a hydroconversion process of heavy or extra-heavy crudes in which the conversion of compounds of high molecular weight is such that allows reducing the viscosity to values that ensure the transportation of such crude oils.

FIG. 1 shows a flow diagram of typical process, in which the hot heavy oil (A), that is an effluent of production center, is fed to the feed/product heat exchanger in order to recover heat from the reactor effluent (B). Before entering the direct fire heater, it is mixed with a hydrogen stream (C) and a catalyst (D). The hydrogen 190 stream may be a mixture of hydrogen of make-up plus the gaseous effluent obtained in the liquid/gas products separator. The catalyst can be added to the hydrocarbon feed dissolved in hydrocarbon or in water. This reaction mixture is added to an adiabatic reactor (E) in which the hydroconversion reaction is carried out. The hot reactor product effluent (B) transfers part of its heat to preheat the fresh feed.

The reactor effluent is recovered in a gas/liquid separator (F). In this equipment, the liquid fraction of hydroconverted hydrocarbon is separated with suitable properties for its transportation by conventional pipelines (G).

A portion of the gaseous fraction (H) is recycled to the direct fire heater for its feedback to the process. The typical composition of this gas includes: hydrogen, hydrogen sulfide and light hydrocarbons in low concentrations. Because the operating conditions of the process are at low severity, the gaseous stream produced in the plant has high hydrogen concentration and low amounts of compounds formed by heteroatoms such as sulfur and nitrogen. Thus, this effluent gas stream (I) may be optionally processed or not in downstream units.

The process can operate with one reactor or two reactors in parallel in order to increase the plant capacity and to reduce production times due to a possible interruption of operation of any of the reactors.

As a result of the catalytic hydroconversion in dispersed phase of the heavy oil, the content of impurities such as organometallic, sulfur and nitrogen compounds is reduced, as well as viscosity is diminished and API gravity of the feed is increased.

The catalyst can be prepared with heavy elements as: Mn, Fe, Co, Ni, Mo, Cu, Cr with different oxidation states and their different types of salts. Preferably compounds of Mo, Fe and Ni are selected due to their low cost. The simplest form of preparation consists of the formation of metal oxides from their different salts. Metal oxides within the reactor atmosphere rich in hydrogen and gaseous sulfur compounds are transformed into sulphides which is the most active form of the metals contained in the catalyst.

The catalytic reaction may develop in a variety of operating conditions, however, it is possible to obtain the transport properties of the upgraded crude oil at low severity conditions in the reactor with operating pressures in the interval of 30 to 100 kg/cm$^2$, temperatures from 320 to 400° C., hydrogen/hydrocarbon ratio of 400 to 2500 ft$^3$/bbl, and space velocity (LHSV=Liquid hourly space velocity) from 0.1 to 3 h$^{-1}$. Depending on the quality of the feed it is possible to combine the different 225 values of these operating conditions and thereby to obtain upgraded crude oils with suitable transport properties.

Since the operating conditions are not of high severity, there is no excessive sediment formation in the process that could plug the reactor or any other equipment of the process.

The amount of catalyst fed to the reactor is between 0.3 to 5 wt. % with respect to the weight of the feed, which is added directly to the feed flow dissolved in the hydrocarbon (when using an oil-soluble catalyst) or in water (when using a water-soluble catalyst).

Within the properties of catalyst, they can have functions of hydrocracking and hydrogenation of the cracked molecules. This is achieved with metal-containing catalysts which have the property to exchange hydrogen atoms such as: Ni, Mo, Fe and Co, among others, and that are also resistant to sulfur poisoning in concentrations in the fresh catalyst up to 70 weight % of the composition depending on the type of compound used.

An additional function of the slurry catalyst used in the process of this invention is to transform the sulfur and nitrogen compounds of the feed into hydrogen sulphide and ammonia, respectively. This is achieved, to some extent, by taking advantage of the property of the catalyst surface to capture by a chemical bond the hydrogen, sulfur and nitrogen atoms, whose function is adequately performed by the active metals of Fe. Ni and Mo in the form of sulfides. They have the ability to break the C—C and C—N—C bonds and they can saturate the sulfur and nitrogen to form hydrogen sulfide and ammonia, respectively.

Among the main technical contributions of the process of this invention, compared to conventional processes to upgrade the transport properties, are the following:

- It can be located next to the production facilities
- It uses operating conditions of low severity
- It is compact and it can be installed in production facilities on ground or offshore
- It upgrades the crude oil properties in a permanent way
- It uses as feed hydrocarbons and gases existing in the production centers
- It operates using dispersed phase reactor to avoiding problems of plugging
- It uses disposable catalysts at low concentrations

EXAMPLES

Some practical examples are described in the following sections in order to have a better understanding of the present invention, without limiting its scope.

Example 1

A heavy oil with 12.93°API and other properties presented in Table 1 was upgraded with the hydroconvers on process of this invention.

TABLE 1

Properties of the heavy crude oil to the process of this invention of Example 1

| Properties | Heavy Crude Oil |
|---|---|
| Specific gravity @ 60/60° F. | 0.9812 |
| API gravity | 12.71 |
| Viscosity, cSt @: | |
| 25.0° C. | 22791 |
| 37.8° C. | 6110 |
| 54.4° C. | 1518 |
| Ramsbottom carbon, wt. % | 16.07 |
| Conradson carbon, wt. % | 16.40 |
| Total sulfur, wt. % | 5.27 |
| Total Nitrogen, ppm | 4870 |
| Basic Nitrogen, ppm | 1740 |
| Insoluble in $nC_5$, wt. % | 24.7 |
| Insoluble in $nC_7$, wt. % | 18.78 |
| Ash, wt. % | 0.086 |
| Nickel, ppm | 78 |
| Vanadium, ppm | 456 |
| Ni + V | 534 |

Operating conditions used are shown in Table 2. The added amount of catalyst was 1 wt % of molybdenu trioxide ($MoO_3$) of high purity whose properties are shown in Table 3.

Table 4 shows the properties of the upgraded crude rail by the process object of this invention.

TABLE 2

Operating conditions of the hydroconversion process of heavy crude oil at low severity of this invention for the Example 1

| Pressure, Kg/cm$^2$ | Temperature, ° C. | | LHSV, h$^{-1}$ | $H_2$/hydrocarbon ratio, ft$^3$/bbl 360° C. | 380° C. |
|---|---|---|---|---|---|
| 40 | 360 | 380 | 0.25 | 507 | 490 |
| 60 | 360 | 380 | 0.25 | 760 | 736 |
| 100 | 360 | 380 | 0.25 | 1270 | 1230 |

TABLE 3

Properties of molybdenum trioxide catalyst used in the hydroconversion process of heavy oil of this invention for the Example 1

| | |
|---|---|
| Size particle | <5 μm |
| Appearance (color) | White |
| Appearance (form) | Powder |
| Purity | ≥99.5% |
| Insoluble material ($NH_4OH$) | ≤0.01% |

TABLE 4

Properties of the upgraded crude oil obtained by hydroconversion process of heavy crude oil of this invention for the Example 1

| | API Gravity | | Sulfur wt. % | | Viscosity @ 37.8° C. cSt | Metals (Ni + V) ppm | |
|---|---|---|---|---|---|---|---|
| Temperature ° C. Pressure, Kg/cm$^2$ | 360 | 380 | 360 | 380 | 380 | 360 | 380 |
| 40 | 14 | 19.5 | 4.83 | 3.5 | 150 | 533 | 533 |
| 60 | 14.1 | 17.9 | 4.82 | 3.6 | 120 | 531 | 530 |
| 100 | 14.2 | 17.8 | 4.86 | 3.7 | 100 | 530 | 528 |

Table 4 shows that at 380° C. in ail cases, the upgraded crude oil has the viscosity specification (<250 eSt at 37.8° C.) with API gravity between 17.8 and 19.5 units, Because it is a dispersed unsupported catalyst, they is not space for the metals to be deposited as in a supported catalyst, for this reason the metal content in the feed (Ni+V=534 ppm) is practically the same than in the products (528-533 ppm). In the case of sulfur removal, the content in the feed (5.27 wt. %) is reduced to between 3.50 and 4.86 weight %, which is equivalent to a reduction between 33.6 and 7.8% respectively.

Example 2

The heavy oil of Example 1, whose properties are presented in Table 1 was upgraded by hydroconversion process using the dispersed phase of this invention, with the same catalyst of Example 1 but varying the amount of catalyst in the reactor from 0.5 to 2 wt. % with respect to the feed at the operating conditions shown in the Table 5.

TABLE 5

Operating conditions for the hydroconversion process of heavy oil at low severity of this invention for the Example 2

| | |
|---|---|
| Pressure, Kg/cm$^2$ | 40 |
| Temperature, ° C. | 380 |

TABLE 5-continued

Operating conditions for the hydroconversion process of heavy oil at low severity of this invention for the Example 2

| | |
|---|---|
| $H_2$/hydrocarbon ratio, ft$^3$/bbl | 490 |
| LHSV, h$^{-1}$ | 0.25 |

The results shown in Table 6 indicate an upgrading in the transport properties of the crude oil. API gravity is increased to values between 18 to 21 units and the viscosity at 37.8° C. is reduced to between 100-180 cSt. Again, metal removal is not observed because an unsupported catalysts is used, and sulfur removal is between 12.7 to 16.5 wt. %.

TABLE 6

Properties of the products obtained in the hydroconversion process of the heavy crude oil of this invention for the Example 2

| Catalyst wt. % | API Gravity | Sulfur, wt. % | Viscosity @ 37.8° C., cSt | Metals, Ni + V, ppm |
|---|---|---|---|---|
| 0.5 | 18 | 4.5 | 100 | 532 |
| 1.0 | 19.2 | 4.6 | 158 | 532 |
| 2.0 | 21 | 4.4 | 180 | 532 |

Example 3

The heavy crude oil of Examples 1 and 2 was treated with the hydroconversion process in dispersed phase of this invention, but using oxide iron (III) of high purity as finely divided catalyst (Table 7) at the operating conditions shown in Table 5.

TABLE 7

Properties of iron oxide catalyst (III) ($Fe_2O_3$) (purity > 99.5%) used in the hydroconversion process of heavy crude oil of this invention for Example 3

| | |
|---|---|
| Size particle | <5 μm |
| Appearance (color) | Dark Red |
| Appearance (form) | Powder |
| Iron content, wt. % | 62.9-71.3 |

The obtained results are shown in Table 8. With the hydroconversion process of this invention an important upgrading in the transport properties of treated crude oil is achieved with a low sulfur removal and a null metal removal.

The liquid yield of the process using either molybdenum trioxide or iron oxide ail) is high as shown in Table 9.

TABLE 8

Properties of the products obtained in the hydroconversion process of heavy crude oil of this invention for the Example 3

| | API Gravity | | Sulfur, wt. % | | Viscosity @ 37.8° C., cSt | Metals, Ni + V ppm | |
|---|---|---|---|---|---|---|---|
| Temperature ° C. Pressure Kg/cm$^2$ | 360 | 380 | 360 | 380 | 380 | 360 | 380 |
| 60 | 17.64 | 18.58 | 5.19 | 4.54 | 188 | 530 | 529 |
| 85 | 17.20 | 18.27 | 4.76 | 4.57 | 136 | 532 | 530 |

TABLE 9

Yield of liquid obtained by hydroconversion process of the heavy crude oil of this invention for Example 3

| Catalyst wt. % | Molybdenum trioxide | Iron oxide (III) |
|---|---|---|
| 0.5 | 88.9 | 85.1 |
| 1.0 | 98.0 | 98.0 |
| 2.0 | 98.0 | 98.0 |

The formation of byproducts such as hydrogen sulfide is low since a high value of hydrodesulfurization is not obtained as shown in Table 10.

TABLE 10

Hydrodesulfurization obtained in hydroconversion process of heavy crude oil of this invention for the Example 3

| Catalyst wt. % | Molybdenum trioxide | Iron oxide (III) |
|---|---|---|
| 0.5 | 14.2 | 14.2 |
| 1.0 | 13.7 | 13.0 |
| 2.0 | 13.7 | 13.1 |

Example 4

The same heavy oil of Example 1 was upgraded with the hydroconversion process described in this invention using commercial grade iron oxide with a high iron content and whose chemical composition is shown in Table 11.

The operating conditions for the hydroconversion process of this invention using commercial grade iron oxide are presented in Table 5. Due to its chemical composition, the amount of this catalyst was adjusted such that an equal molar amount of iron was fed to the process than when analytical grade catalysts was used.

The obtained results are summarized in Table 12. With this catalyst a significantly upgrading of transport properties is obtained which is similar to that achieved using analytical grade iron oxides.

TABLE 11

Chemical composition of commercial iron oxide used in the process described in this invention for the Example 4

| Composition wt. % | Commercial iron oxide |
|---|---|
| Fe | 72.060 |
| O | 16.710 |
| Si | 0.185 |
| Ca | 5.190 |
| C | 3.070 |
| Others | 2.785 |

TABLE 12

Properties of the products obtained by hydroconversion process in the heavy oil of this invention using commercial iron oxide of the Example 4.

| Catalyst | API Gravity | Viscosity @ 37.8° C. cSt | Sulfur wt. % | Metal (Ni + V) ppm |
|---|---|---|---|---|
| Commercial grade iron oxide | 17.1 | 203 | 4.55 | 532 |

Example 5

The same crude from Example 1 was treated using hydroconversion process of this invention using as catalysts both oxide iron (III) as molybdenum trioxide of high grade of purity at the conditions shown in Table 5 and varying the contact time. The products obtained with the process of this invention have suitable properties for their handling and transportation by pipeline when the contact time is longer than 4 hours, which shown in Tables 13 and 14.

TABLE 13

Properties of the products obtained by hydroconversion process in the heavy oil of this invention using iron oxide of high grade of purity of the Example 5

| Contact time (h) | API Gravity | Viscosity@ 37.8° C. cSt | Sulfur wt. % |
|---|---|---|---|
| 4 | 18.4 | 190 | 4.59 |
| 5 | 18.7 | 189 | 4.52 |

TABLE 14

Properties of the products obtained by hydroconversion process in the heavy oil of this invention using molybdenum trioxide of high grade of purity of the Example 5

| Contact time (h) | API Gravity | Viscosity@ 37.8° C. cSt | Sulfur wt. % |
|---|---|---|---|
| 4 | 18.2 | 185 | 4.52 |

The invention claimed is:

1. A catalytic hydroconversion process in dispersed-phase at low severity for upgrading properties of extra-heavy and heavy crude oils having API gravity between 3 to 16 and kinematic viscosity at 37.8° C. higher than 6000 cSt for transporting the crude oil, said process comprising mixing an extra heavy or heavy crude oil stream with a hydrogen stream in a hydrogen/hydrocarbon ratio of 400-2500 $ft^3$/bbl and a catalyst stream at a concentration of 0.5 to 2 wt % based on the weight of the crude oil to produce a reaction stream, feeding the reaction steam to a direct fire heater to heat the reaction stream;

feeding the heated reaction stream of said extra heavy and heavy crude oil at temperature in the range of 50 to 200° C. to a feed/product heat exchanger and recovering heat from the reaction stream for heating said extra heavy and heavy crude oil stream;

feeding the reaction stream to an adiabatic reactor and subjecting the reaction stream to hydroconversion at a temperature of 320-400° C., pressure of 30-100 $Kg/cm^2$, and liquid space-velocity between 0.1 and 3.0 $h^{-1}$;

feeding the resulting reactor effluent to a gas/liquid separator and recovering a hydroconverted liquid hydrocarbon fraction for transportation by conventional processing lines and a gaseous fraction containing hydrogen, hydrogen sulfide and light hydrocarbons at low concentrations; and recycling said gaseous fraction to said hydrogen stream for mixing with and preheating the extra heavy or heavy crude oil stream and hydrogen stream for feeding to the direct fire heater.

2. The catalytic hydroconversion process at low severity in accordance with claim 1, wherein said catalyst is a powder or oil soluble and dissolved in a hydrocarbon or water soluble and dissolved in water.

3. The catalytic hydroconversion process at low severity in accordance with claim 1, wherein said adiabatic reactor is at a reactor pressure between 40 to 80 $Kg/cm^2$, reaction temperature between 350 to 380° C., hydrogen/hydrocarbon ratio between 400 to 1500 $ft^3$/bbl, and liquid space velocity between 0.1 to 0.5 $h^{-1}$.

4. The catalytic hydroconversion process at low severity in accordance with claim 1, wherein said catalyst includes at least one selected from the group consisting of Mn, Fe, Co, Ni, Mo, Cu, and Cr, and where said catalyst is fed to the adiabatic reactor together with the extra-heavy or heavy crude oils.

5. The process of claim 4, wherein said catalyst is selected from the group consisting of molybdenum and iron oxides and sulfides.

6. The catalytic hydroconversion process at low severity in accordance with claim 1, wherein said catalyst is in powder form with a particle sizes of 5 to 500 microns.

7. The process, in accordance with claim 1, wherein said catalyst comprises up to 80 wt. % of Mo or Fe.

8. The catalytic hydroconversion process at low severity, in accordance with claim 1, wherein said adiabatic reactor comprises two reactors in parallel.

9. The catalytic hydroconversion process at low severity, in accordance with claim 1, where said process produces a liquid hydrocarbon yields of up to 98 vol. %.

10. The process according to claim 1, wherein said process increases the API gravity of said recovered liquid hydrocarbon fraction by 8.4 units and reduces the viscosity of said recovered hydrocarbon fraction as measured at 37.8° C. by up to 98.5% relative to said extra-heavy and heavy crude oil feed.

* * * * *